US012146657B2

(12) United States Patent
Spevak et al.

(10) Patent No.: US 12,146,657 B2
(45) Date of Patent: Nov. 19, 2024

(54) GRATELESS, BACK DRAFTED AND BACK FED PELLET STOVE

(71) Applicants: Stephen Thomas Spevak, Winchester, VA (US); Frederick Arlen Leavitt, San Diego, CA (US)

(72) Inventors: Stephen Thomas Spevak, Winchester, VA (US); Frederick Arlen Leavitt, San Diego, CA (US)

( * ) Notice: Subject to any disclaimer, the term of this patent is extended or adjusted under 35 U.S.C. 154(b) by 0 days.

(21) Appl. No.: 16/713,385

(22) Filed: Dec. 13, 2019

(65) Prior Publication Data

US 2022/0090780 A1 Mar. 24, 2022

(51) Int. Cl.

| | |
|---|---|
| ***F23B 30/00*** | (2006.01) |
| ***F23K 1/00*** | (2006.01) |
| ***F23L 17/00*** | (2006.01) |
| ***F24B 5/02*** | (2006.01) |
| ***F24B 13/04*** | (2006.01) |
| *C10L 5/36* | (2006.01) |
| *C10L 5/44* | (2006.01) |

(52) U.S. Cl.

CPC ..... *F23B 1/16* (2013.01); *F23K 1/00* (2013.01); *F23L 17/005* (2013.01); *F24B 5/021* (2013.01); *F24B 13/04* (2013.01); *C10L 5/363* (2013.01); *C10L 5/442* (2013.01); *C10L 2200/0469* (2013.01); *C10L 2270/08* (2013.01); *F23K 2201/00* (2013.01)

(58) Field of Classification Search

CPC .. F23B 1/16; F24B 5/021; F24B 13/04; F23K 1/00; F23K 2201/00; F23L 17/005; C10L 5/442; C10L 5/363; C10L 2270/08; C10L 2200/0469

See application file for complete search history.

(56) References Cited

U.S. PATENT DOCUMENTS

| | | | | |
|---|---|---|---|---|
| 4,607,610 | A * | 8/1986 | Zimmermann | F23L 3/00 126/76 |
| 9,845,957 | B2 * | 12/2017 | Hill | F23J 1/00 |
| 10,408,459 | B2 * | 9/2019 | Hill | F24B 13/02 |
| 11,175,047 | B2 * | 11/2021 | Hill | F24B 13/04 |

FOREIGN PATENT DOCUMENTS

| | | |
|---|---|---|
| JP | 2006300451 | * 11/2006 |

* cited by examiner

*Primary Examiner* — Cephia D Toomer

(57) ABSTRACT

A system for combusting fuel comprising an apparatus that receives fuel that is characterized as comprising interstitial spacing and wherein oxidants pass through the interstitial spacing of the fuel to sustain a combustion reaction at the interface of a reaction chamber while the byproducts of combustion pass into the reaction chamber.

17 Claims, 5 Drawing Sheets

GRATELESS, BACK DRAFTED AND BACK FED PELLET STOVE

BACKGROUND

1. Field of the Invention

The present invention relates generally to Wood Burning Stoves, and more specifically, to Pellet Stoves designed to use wood pellet fuel for heating homes, commercial buildings and shelters.

2. Description of Related Art

Stoves designed to burn wood pellets are well known in the art and are an effective means of efficiently and cost effectively heating homes. For example, FIG. 1 depicts a conventional pellet stove system 101 having a combustion blower 102, a pellet feeder 103, a burner basket 104 and a room air blower 105. During use, the pellet feeder 103 feeds wood pellets 106 into the burner basket 104 where combustion is initiated. Combustion air 107 is drawn to the pellets by means of combustion blower 102. Because the pellet feed rate, the combustion air flow and the room air flow can be accurately controlled, the pellet stove is a popular and convenient source of clean heat that can keep a home at a comfortable temperature.

One of the problems commonly associated with system 101 is that it is complicated and difficult to maintain. For example, the pellet feeder 103 is unreliable and often fails to deliver pellets properly and is expensive and difficult to replace.

Another problem commonly associated with system 101 is the impact of high temperatures on its component parts. For example, ash buildup within burner basket 104 sinters together under the high temperatures complicating cleaning. Further, basket 104 corrodes quickly under the intense heat and requires frequent replacement. Prior art attempts to slow the corrosion of basket 104 by fabricating it from exotic refractory materials, significantly increases the cost of the component.

Another problem commonly associated with system 101 is the expense of its complicated construction and numerous components.

Another problem commonly associated with system 101 is that it requires substantial amounts of electricity to operate. For example, combustion blower 102, room air blower 105 and pellet feeder 103 are typically driven by electricity. In America, many consumers purchase wood stoves to have a reliable source of heat in the event of a power failure. Because most prior art pellet stoves can't operate during a power failure, without the use of a battery, its popularity is far below that of less efficient cord wood stoves.

While several pellet stoves that don't use electricity have been offered for sale, they are unreliable and cumbersome to use and have not been commercially successful.

Accordingly, although great strides have been made in the area of pellet stoves, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
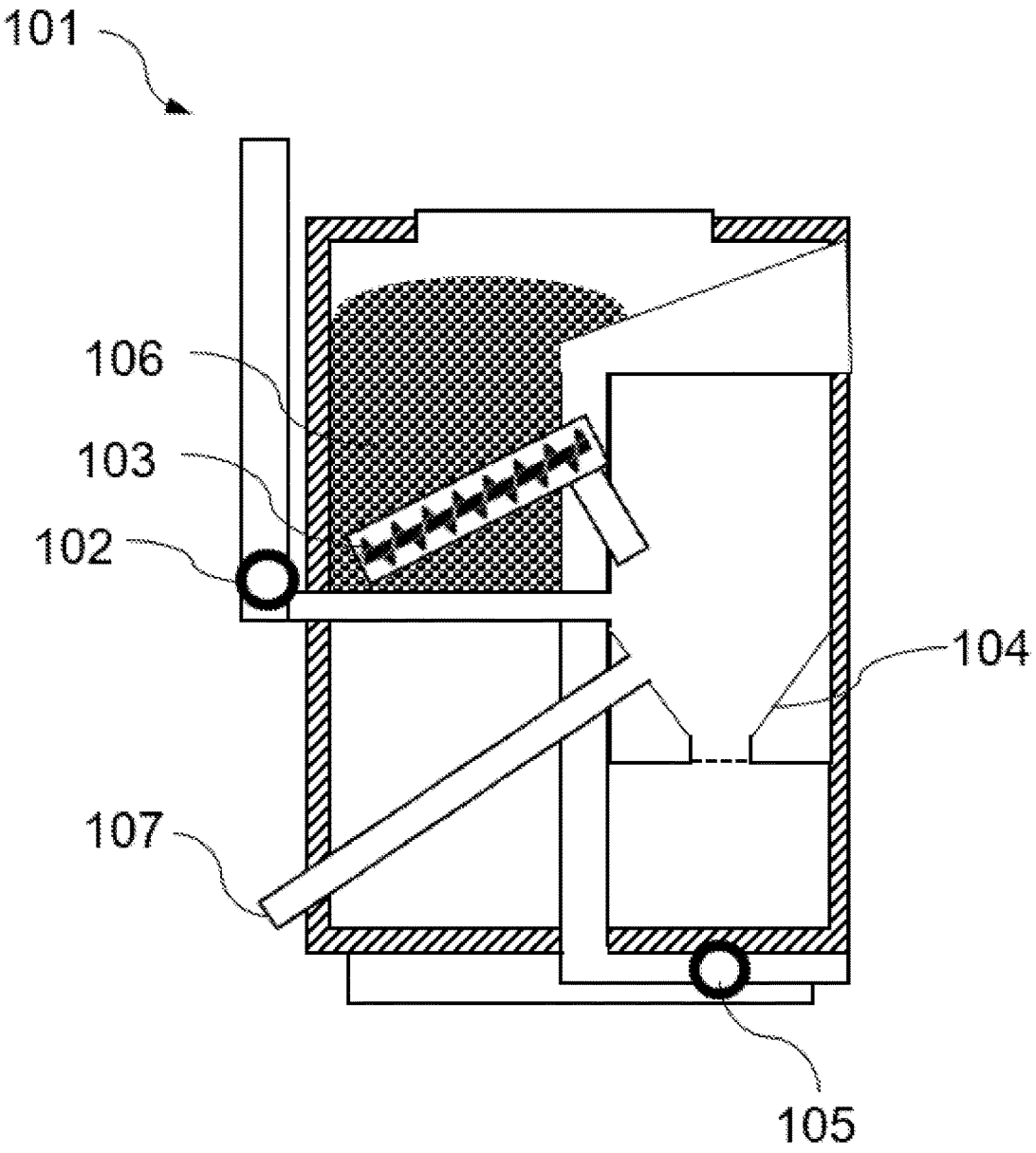
FIG. 1 (Prior art)
FIG. 1 is a cross sectional side view of a common pellet stove system.
Figure 2:
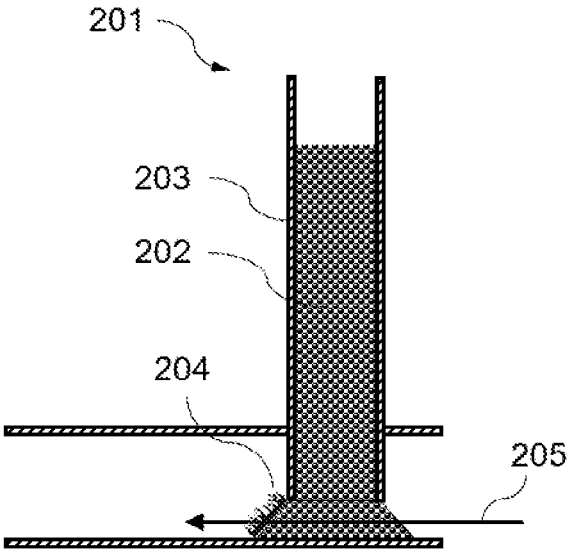
FIG. 2 is a cross sectional side view of the present application in its simplest form.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional pellet stoves. Specifically, system 201 describes the present application in its simplest form. Pellets 202 held in pellet tube 203 are dispensed by gravity into combustion zone 204, eliminating the need for the expensive and unreliable pellet feeder used in most prior art stoves. Additionally, the pellet feeder is a large consumer of electricity in the prior art pellet stove. Since the pellets fall onto a flat surface and the combustion air is fed to the combustion zone from behind the pellets, no burner basket or grate is necessary—thereby eliminating the most troublesome component of the prior art stove. Additionally, without a burner basket, the surfaces exposed to the intense temperatures in the combustion zone 204 are minimized nearly eliminating the surfaces that need to be fabricated from expensive exotic materials.

Because the present application is completely solid state, except for a small draft inducer, the entire system can operate on little or no electricity. This will allow the system to be operated independent of an electrical power source or at most with the use of a small battery which can be readily recharged by a small solar panel or some other means. Finally, since the present application can be assembled from five or less components, it can be inexpensively fabricated.

These, and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 3A:
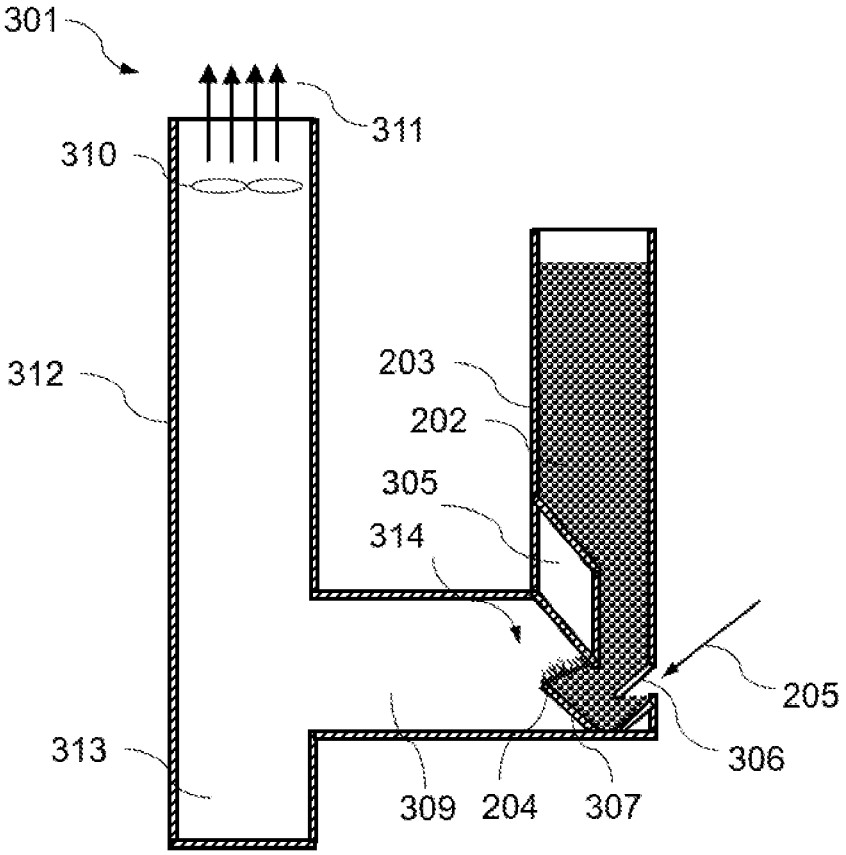
FIG. 3A is a cross sectional side view of the preferred embodiment after fuel has been added and shortly after combustion has been initiated.

Referring now to the drawings wherein like reference characters identify corresponding or similar elements throughout the several views, FIG. 3A depicts a drawing of a grateless, back drafted and back fed pellet stove in accordance with a preferred embodiment of the present application. It will be appreciated that system 301 overcomes one or more of the above-listed problems commonly associated with conventional pellet stove systems.

In the contemplated embodiment, system 301 includes a pellet tube 203 which is a fuel dispenser directing wood pellets 202 to combustion zone 204. Insulator 305 prevents the flame from heating the pellets in pellet tube 203. Prematurely heating the pellets could cause them to char or even ignite prematurely. Another problem with preheating of the fuel can occur if the pelletized fuel contains excessive moisture. Preheating fuel with excessive moisture can cause them to swell, increasing the probability of the pellets becoming lodged in pellet tube 203. Angling the vertical surface of insulator 305 that is in contact with pellets 203 such that the channel through which the pellets flow becomes larger as the pellets travel down the tube will further ensure that the pellets do not become lodged in pellet tube 203.

Deflector plate 306 directs the pellets into pellet trough 307 which is a cache for the fuel. Pellet trough 307 holds a small cache of fuel (wood pellets) in a fixed volume and location while leaving the pellets exposed on both sides. One side of the pellets are exposed to ambient outside air 205 while the other side of the pellets in the pellet trough are exposed to reaction chamber 309. The pellets are dispensed into trough 307 from above. The pellet trough performs at least two functions. It prevents the pellets from rolling away from the combustion chamber and it holds the fuel in a well-defined volume. Having the fuel in a well-defined volume is important because it keeps the distance that the combustion air must travel through the fuel relatively constant resulting in more consistent combustion.

Coating the surface of pellet trough 307 that is in contact with the fuel with a low-cost insulating material such as Kaowool ceramic fiber can be helpful in two ways. It reduces the temperatures to which the pellet trough is exposed, increasing the life of trough 307 and it keeps the combustion temperatures of the fuel high, increasing efficiency and reducing emissions.

Combustion zone 314 is the area in the immediate vicinity of the flame front which divides the fuel from reaction chamber 309. This interface between the fuel and reaction chamber 309 is not a well-defined interface but rather a zone that can encompass the entire pellet trough 307. As the fuel approaches combustion zone 314 it becomes increasingly hot. As the fuel is heated several different volatile gases (or volatile organic compounds, VOC's) are released from the fuel. These VOC's react with the air passing through the interstitial spaces between the pieces of granular fuel and begin to combust. After the VOC's have been released, oxygen in combustion air 205 reacts with the remaining carbon forming $CO_2$ and CO gases. After complete combustion of the fuel, the noncombustible minerals originally in the fuel remain as ash.

Figure 3B:
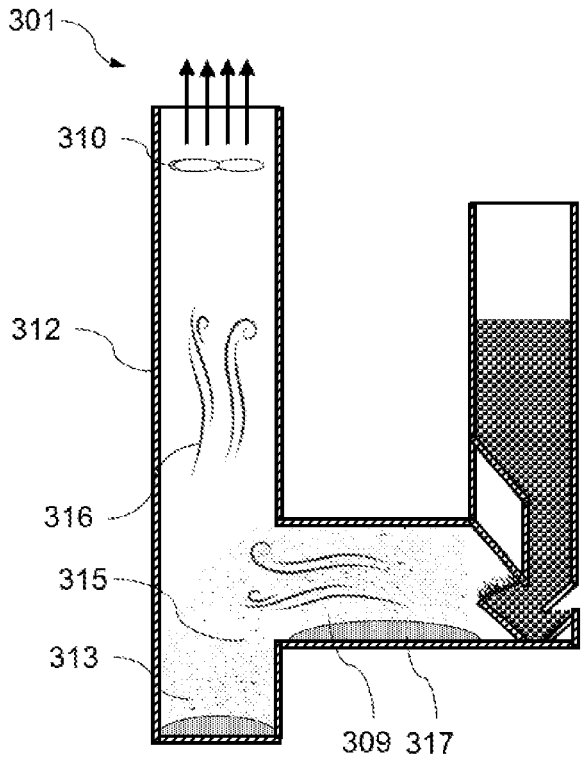
FIG. 3B is a cross sectional side view of the preferred embodiment after it has been operating for a short time; Specification Page 4

The VOC's, CO, and $CO_2$ are referred to as combustion gases 316 and can be seen in FIG. 3B. Combustion gases 316 and ash 315 are referred to as combustion products. The combustion products are carried out of the combustion zone into reaction chamber 309 where combustion continues to take place. It may be useful to bring secondary combustion air into combustion chamber 309 to ensure that sufficient oxygen is present for complete combustion.

Draft inducer 310 draws the combustion products from reaction chamber 309 to exhaust tube 312. While gases 316 in the combustion products continue up the exhaust tube, ash 315 will fall and accumulate in ash tray 313. A simple cyclone separator may be useful to ensure that as much of the ash as possible is collected and not released to the outside. Ideally, draft inducer 310 will be located at the end of the flue outside the residence but it is often more convenient to locate the draft inducer within the stove or shelter. Locating draft inducer 310 outside the residence will create a negative pressure inside the stove and the associated ducting, eliminating the risk of combustion products leaking into the residence.

Figure 3C:
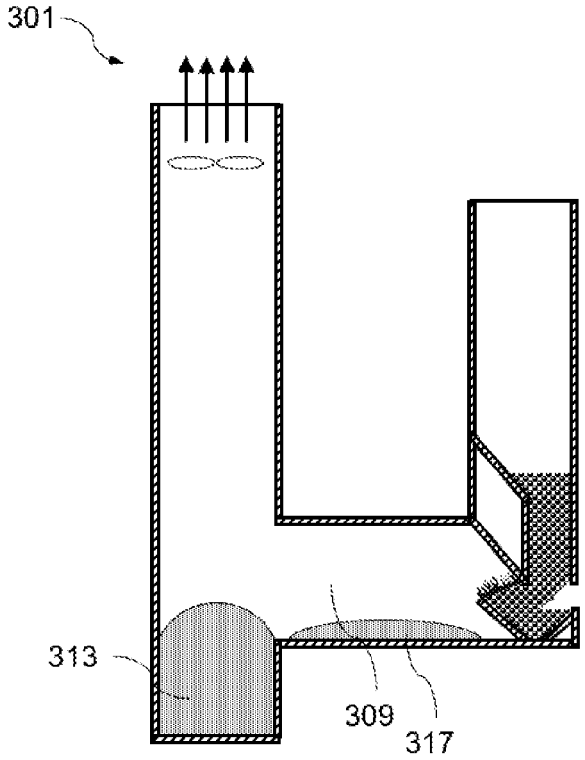
FIG. 3C is a cross sectional side view of the preferred embodiment after having operated for a significant period of time.

As system 301 is operated, some ash 317 will accumulate in combustion chamber 309 but most of the ash is collected in ash tray 313 as seen in FIG. 3B. As system 301 continues to operate however, the amount of ash 317 in combustion chamber 309 remains stable and additional ash is carried to ash tray 313 where it accumulates as seen in FIG. 3C.

Figure 4:
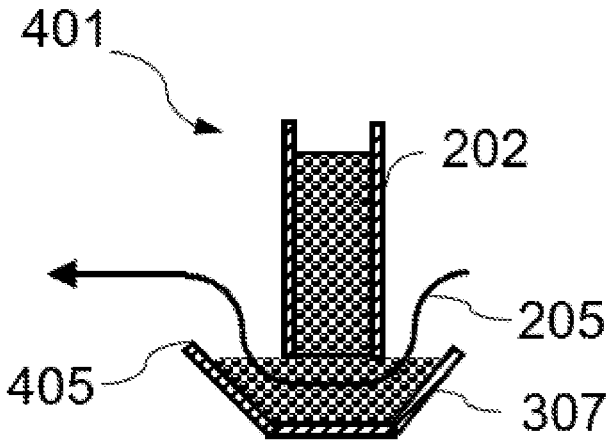
FIG. 4 is a cross sectional side view of the pellet trough that contains the pellet fuel.

It should be appreciated that one of the unique features believed characteristic of the present application is combustion system 401, illustrated in FIG. 4. When wood pellets 202 are fed into pellet trough 307 they are confined to a predefined volume and exposed on both sides. When combustion air 205 is drawn from the side exposed to air, through the pellets in pellet trough 307 to the combustion side, it ensures that combustion takes place within the pellets themselves.

Pellet trough 307 also ensures that most of the combustion takes place away from any surface. When a conventional burner basket 104 is used to contain the pellets, the intense flame of combustion is directed onto the basket itself. The extreme temperatures of combustion can lead to accelerated deterioration of the basket necessitating frequent replacement and the use of exotic materials.

In the preferred embodiment, only trailing edge 405 of pellet trough 307 is in direct contact with the flame. While the pellet trough can be fabricated from inexpensive materials making it cheap and easily replaced, the life of the pellet trough can be extended by adding a thin layer of inexpensive ceramic fiber insulation such as Kaowool onto the surface of the pellet trough thereby reducing the temperatures of the metal. Making the trailing edge long and allowing it to erode back over an extended period can also extend the life of the trough. A more expensive but longer lasting pellet trough can be fabricated by making trailing edge 405 from refractory alloys or ceramics.

Another unique feature believed characteristic of the present application is that as the wood pellets are consumed, new pellets are fed into the combustion zone from behind the flame front. In most prior art pellet stoves, new pellets are dropped into the combustion zone tending to quench the flame, momentarily creating harmful smoke and volatile gases.

Pellet tube 302, reaction chamber 309 and exhaust tube 312 in the preferred embodiment are fabricated from 4"×4", 11 gauge steel tubing. This size of tubing is well suited to using standard sized wood pellets as defined by the Pellets Fuel Institute (PFI) which is 0.25" to 0.285" in diameter and up to 1.5" long. Pellets of a different geometry may work better with a different sized pellet tube 203.

Another unique feature believed characteristic of the present application is the scalability of the pellet stove. The present application can be easily scaled in at least two different ways. System 301 described in the preferred embodiment produces up to 12 kW of heat. If this tubing were to be made twice as wide using 4"×8" tubing and extending pellet trough 307, insulator 305 and deflection plate 306 from 4" wide to 8" wide, then the stove would produce up to 24 kW of heat. This same concept of scalability could be extended to any width resulting in a stove of any size.

Figure 5:
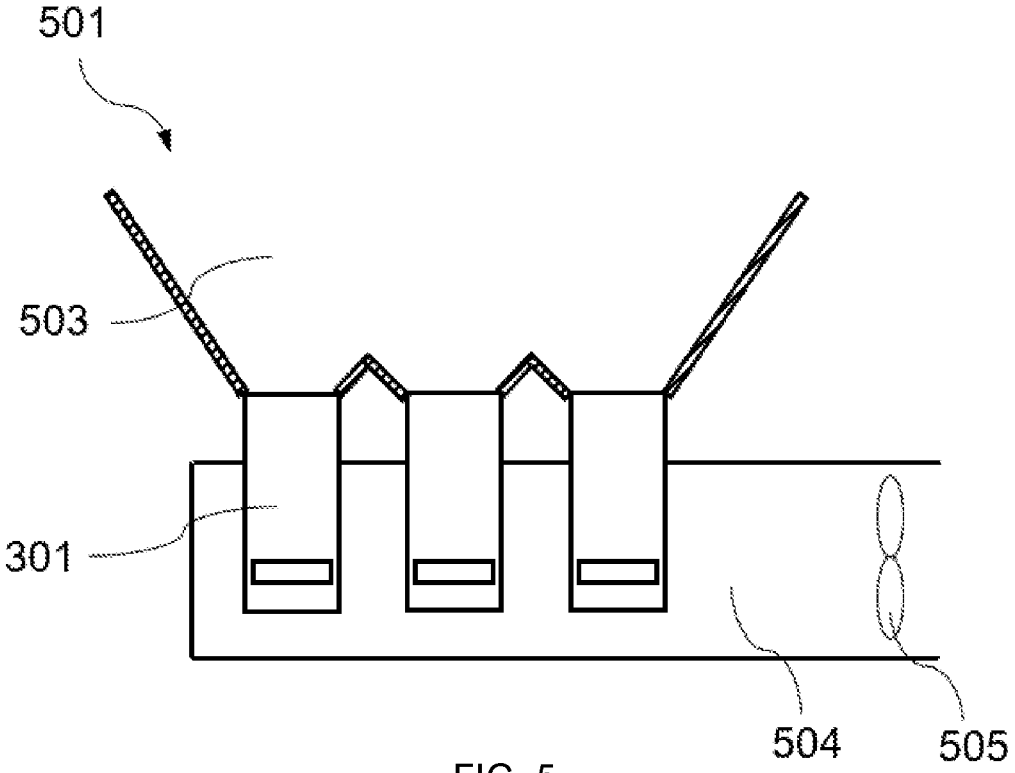
FIG. 5 is a side view of three of the present application stoves used in conjunction.

Alternatively, the present application could be scaled by assembling multiple systems 301 adjacent to each other as illustrated in FIG. 5. System 501 shows three systems 301 that feed from the same pellet hopper 503 and direct combustion products into a single flue 504. A single draft inducer 505 can induce the necessary draft in all the systems.

Figure 6:
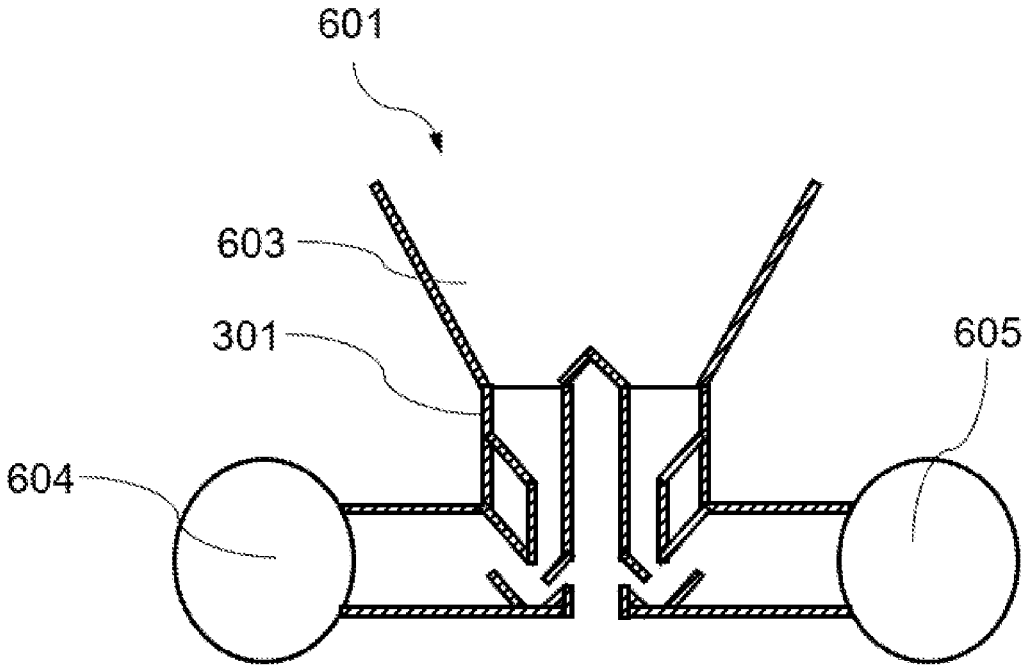
FIG. 6 is a cross sectional view of two banks of the three stoves represented in FIG. 5 viewed from one end.

FIG. 6 illustrates how two banks of system 501 can double the capacity with only a small increase in the volume of the system. System 601 is an end view showing two stoves 301 feeding from a single pellet hopper 603 while directing their exhaust gases into two separate flues 604 & 605. The advantage of this method of scaling the capacity of the stove is that system 601 can fire as many or as few of the six system 301's as necessary to provide a wide range of heat without degrading the efficiency of the system.

Another unique feature believed characteristic of the present application is the low amount of electricity required to operate the stove. The draft inducer for the preferred embodiment uses a 12 VDC, 8 watt, 43 cfm blower to draw combustion air through the pellets. No other electricity is required. A typical prior art pellet stove can use more than 100 watts of electricity to power its blower and pellet feeder. While combustion in pellet stoves are commonly ignited with electrically heated ignitors that take 200 watts or more of power, the ignitors are only on for a minute or two so the total energy consumed in small.

Another unique feature believed characteristic of the present application is the ease with which the amount of heat produced by the stove can be adjusted. The preferred embodiment uses a 12 VDC blower. This blower can accept electricity as high as 14 volts, at which point it will produce maximum draft and therefor maximum heat, or it can be turned down to 8 volts at which point it produces minimum draft and minimum heat. If properly ducted to create a strong draft, the stove will continue to operate well (albeit at a lower rate) with the blower turned off.

One can contemplate draft inducers that require no electricity such as using compressed air to induce a draft using the venturi effect or non-electric motors such as pneumatic or hydraulic motors. If designed properly, the draft inducer may even be the natural draft induced by hot air rising up a stack.

Another unique feature believed characteristic of the present application is the ability of the stove to completely consume the wood pellet fuel. As previously described, prior art stoves burn wood pellets in a basket or use a grate to allow air to enter the wood pellets and ash to leave the combustion zone. As the wood pellet in the basket is consumed, it is reduced in size until the pellet falls through the basket or grate into the ash tray. Sometimes, incompletely consumed pellets will continue to burn while in the ash tray, but many will not. This incomplete combustion wastes fuel and creates emissions. In the preferred embodiment, ash is drawn out of pellet trough 307 along with other combustion products by the combustion air flowing through it. This ash will continue to flow down combustion tube 309 and fall into ash tray 313. While ash 317 will accumulate in pellet trough 307 and in reaction zone 309, at some point the amount of accumulated ash comes to an equilibrium as the amount of new ash generated equals the amount of ash carried away.

While the preferred embodiment describes a stove that consumes wood pellet fuel, a wide variety of organic fuel can be contemplated including pyrolyzed wood, charcoal fuel, torrified fuel, or thermally exploded fuel such as steam exploded biofuel as described in the paper written by Wolfgang Stelte and published by the Danish Technological Institute titled "Steam Explosion for Biomass Pretreatment for the Energy & Climate Centre for Renewable Energy and Transport Section for Biomass. Many agricultural products or agricultural waste are suitable fuels including corn, cherry pits and peach pits.

Oxidants other than air can also be contemplated. Gases rich in oxygen are common oxidants, or gases carrying suspended solid oxidants such as nitrates or permanganates can also be contemplated.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A system for combusting fuel comprising:

one or more reaction chambers comprising one or more caches of fuel and one or more combustion zones wherein the caches of fuel form an interface between the one or more reaction zones and;

one or more oxidants;

wherein the one or more caches of fuel comprise individual units of fuel with interstitial spacing that enables the one or more oxidants to flow through the fuel and;

one or more dispensers comprising:

one or more inlets configured to receive one or more of the fuel or oxidants; and one or more outlets configured to release the fuel and oxidants into one or more caches of fuel;

wherein one or more of the outlets of the one or more dispensers are in communication with the one or more caches of fuel during combustion;

wherein the one or more fuels contained in the one or more caches of fuel forms an interface between the one or more oxidants and the one or more reaction chambers;

wherein the caches of fuel fit within the reaction chamber in such a way as to force the one or more oxidants to pass through the interstitial spacing of the one or more caches of fuel;

wherein the one or more oxidants pass through the one or more caches of fuel without the use of a grate;

wherein the one or more caches of fuel and the one or more oxidants passing through the one or more caches of fuels interact at the interface between the one or more fuels and the one or more oxidants to enable combustion.

2. The system of claim 1, the one or more caches of fuel, wherein the fuel comprises a plurality of individual units of organic matter or biomass.

3. The system of claim 2, wherein the individual units of organic matter or biomass have been pyrolyzed.

4. The system of claim 2, wherein the organic matter or biomass has been torrefied.

5. The system of claim 2, wherein the individual units of organic matter or biomass have been thermally exploded.

6. The system of claim 1 further comprising a draft inducer configured to circulate the one or more oxidants through the interstitial spacing of the one or more caches of fuel.

7. The system of claim 6 further comprising a motor configured to drive the draft inducer.

8. The system of claim 1, the dispenser, where the dispenser is a gravity dispenser.

9. The system of claim 1, the one or more outlets configured to release the fuel and oxidants, further comprising a cache of fuel to confine the released fuel to a fixed volume.

10. The system of claim 1 further comprising thermal insulation configured to retain heat within the one or more combustion zones.

11. The system of claim 1 further comprising thermal insulation configured to shield the one or more dispensers of fuel from heat except at the one or more combustion zones.

12. A method for combusting fuel, the method comprising:

the system of claim 1;

loading the system with fuel comprising interstitial spacing;

delivering the fuel to a combustion zone;

passing one or more oxidants to the combustion zone via the interstitial spacing of the fuel; and igniting the fuel and one or more oxidants at or near the combustion zone.

13. The method of claim 12, the method further comprising:

separating the combustion zone from the oxidant source via a fixed volume of fuel.

14. The method of claim 12, the method further comprising:

manipulating the rate at which the one or more fuels react with the one or more oxidants by manipulating oxidant flow.

15. The method of claim 12, the method further comprising delivering the fuel to a combustion zone via gravity.

16. A method of operating a grateless, back drafted and back fed stove for combusting fuel consisting of discrete pieces, wherein the stove comprises:

one or more fuel dispensers in communication with one or more grateless caches in communication with one or more reaction chambers, one or more draft inducers, and one or more igniters; and one or more oxidants and fuel consisting of discrete pieces and having interstitial spacing between the discrete pieces, the method comprising:

dispensing the fuel to the one or more caches via the one or more fuel dispensers;

feeding the one or more oxidants to the one or more reaction chambers through the one or more caches and through the interstitial spacing of the fuel via the one or more draft inducers;

heating the fuel at the interface between the one or more caches and the one or more reaction chambers in the presence of the one or more oxidants until the fuel and one or more oxidants ignite;

combusting the fuel at the interface between the one or more caches and the one or more reaction chambers;

passing the combustion products from the one or more interfaces of the one or more caches and the one or more reaction chambers into the one or more reaction chambers via the one or more draft inducers;

discharging all combustion products from the one or more reaction chambers via the draft inducer.

17. The method of claim 16 further comprising adjusting the temperature of the grateless, back drafted and back fed stove by increasing or decreasing the flow of the one or more oxidants to the one or more caches.

* * * * *